United States Patent [19]

Hill et al.

[11] 4,387,155

[45] Jun. 7, 1983

[54] SPECTRALLY SENSITIZED PHOTOSENSITIVE SILVER HALIDE EMULSION

[75] Inventors: Ruth L. Hill, Dover; Roger E. Jerry, Lexington, both of Mass.

[73] Assignee: Polaroid Corporation, Cambridge, Mass.

[21] Appl. No.: 267,363

[22] Filed: May 26, 1981

[51] Int. Cl.[3] ..... G03C 1/18; G03C 1/19; G03C 1/14

[52] U.S. Cl. ..... 430/217; 430/574; 430/588; 542/473

[58] Field of Search ..... 430/588, 574, 217; 542/473

[56] References Cited

U.S. PATENT DOCUMENTS

| | | | |
|---|---|---|---|
| 2,233,509 | 3/1941 | Brooker et al. | 430/588 |
| 3,955,996 | 5/1976 | Hinata et al. | 430/588 |
| 3,967,967 | 7/1976 | Hinata et al. | 430/574 |
| 4,110,116 | 8/1978 | Beretta et al. | 542/473 |
| 4,179,296 | 12/1979 | Sato et al. | 430/588 |

OTHER PUBLICATIONS

Kiprianov et al, "Cyanine Dyes Containing Fluorine," J. Gen. Chem. USSR, 20, 2111; Eng. trans. 2187 (1950).

*Primary Examiner*—Mary F. Downey
*Attorney, Agent, or Firm*—Philip G. Kiely

[57] ABSTRACT

Photosensitive silver halide emulsions containing a green-sensitive dye of the formula wherein R is hydrogen or chlorine. The invention is also directed to the novel sensitizing dyes.

20 Claims, 5 Drawing Figures

SPECTRALLY SENSITIZED PHOTOSENSITIVE SILVER HALIDE EMULSION

BACKGROUND OF THE INVENTION

It is known in the art to extend the inherent photosensitive response of silver halide emulsions by the incorporation therein of spectral sensitizing dyes. In color photographic elements a plurality of silver halide emulsions are employed, sensitized to different portions of the spectrum, e.g. a red-sensitized silver halide emulsion, a green-sensitized silver halide emulsion and a blue-sensitized silver halide emulsion. In panchromatically sensitized emulsions, generally a combination of dyes are employed to provide the requisite sensitivity from about 400 nm to 650 nm.

Diffusion transfer photographic products and processes are known to the art and details relating thereto can be found in U.S. Pat. Nos. 2,983,606; 3,415,644; 3,415,645; 3,415,646; 3,473,925; 3,482,972; 3,551,406; 3,573,042; 3,573,043; 3,573,044; 3,576,625; 3,576,626; 3,578,540; 3,569,333; 3,579,333; 3,594,164; 3,594,165; 3,597,200, 3,647,437; 3,672,486; 3,672,890; 3,705,184; 3,752,836; 3,857,865, all of which are incorporated here in their entirety. Essentially, diffusion transfer photographic products and processes involve film units having a photosensitive system including at least one silver halide layer, usually integrated with an image-providing material. For example, a photosensitive element comprising a support carrying a red-sensitive silver halide emulsion having associated therewith a cyan dye developer, a green-sensitive silver halide emulsion having associated therewith a magenta dye developer and a blue-sensitive silver halide emulsion having associated therewith a yellow dye developer is known. After photoexposure, the photosensitive system is developed to establish an imagewise distribution of a diffusible image-providing material, at least a portion of which is transferred by diffusion to an image-receiving layer capable of mordanting or otherwise fixing the transferred image-providing material. In some diffusion transfer products, the transfer image is viewed by reflection after separation of the image-receiving element from the photosensitive system. In other products, however, such separation is not required and instead the transfer image-receiving layer is viewed against the reflecting background usually provided by a dispersion of a white reflecting pigment, such as, for example, titanium dioxide. The latter type of film unit is generally referred to in the art as integral negative-positive film units and is described, for example, in the above mentioned U.S. Pat. Nos. 3,415,644 and 3,594,165.

U.S. Pat. No. 3,362,819 teaches image-receiving elements particularly adapted for employment in the preceding diffusion transfer processes which comprise a support layer possessing on one surface thereof, in sequence, a polymeric acid layer, preferably an inert timing or spacer layer, and an image-receiving layer adapted to provide a visible image upon transfer to said layer of diffusible dye image-forming substance.

Commercial color photographic elements generally employ more than one green sensitizing dye for the green-sensitive emulsion. The use of a plurality of green dyes is necessitated by the failure of a single dye to provide a sufficiently broad spectral response without extending into the red region.

Other problems associated with sensitizing dyes include the inability to adsorb sufficiently to the silver halide grain to avoid displacement, and lack of shelf life stability.

It is the object of this invention to provide an improved spectral sensitizing dye for the green region, and photosensitive elements and photographic film units containing such a sensitizing dye. This and other objects of the invention will become apparent from the following detailed description of the invention.

SUMMARY OF THE INVENTION

The present invention is directed to novel sensitizing dyes adapted to sensitive silver halide emulsions to the green portion of the spectrum and to photosensitive elements containing such dyes. The dyes of the present invention are represented by the formula

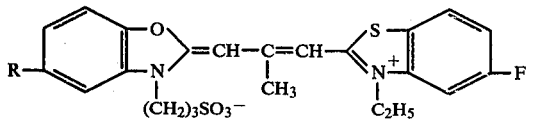

wherein R is hydrogen or chlorine.

DETAILED DESCRIPTION OF THE INVENTION

Figure 1:
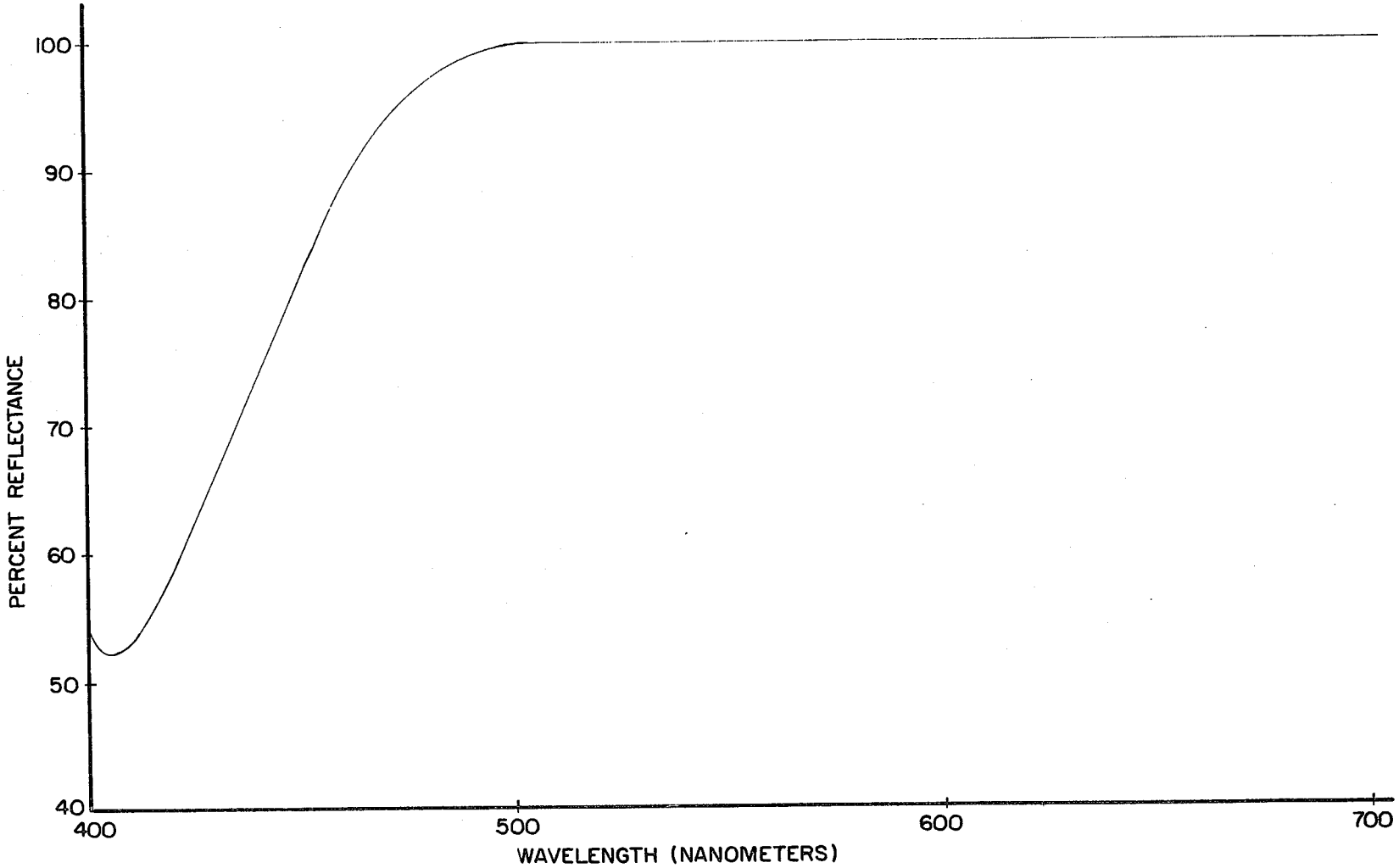
FIG. 1 is the reflection spectrum of a silver halide emulsion which contains no sensitizing dye.

The novel dyes of the present invention adsorb strongly to the silver halide grains and are not displaced by stabilizers or other emulsion addenda. Prior art sensitizers that have had good adsorption characteristics generally exhibited a relatively narrow spectral absorption band or other detrimental characteristics such as emulsion fog. The dyes of the present invention also exhibit superior shelf-life characteristics.

A preferred dye of the present invention provides broad absorption and action spectrum that encompasses the entire green region of the spectrum without the use of additional or auxiliary sensitizers. Thus, it is possible to sensitize silver halide to the entire green region with one dye and without tailing into the red region of the spectrum. The sensitivity of the emulsions containing the dye of the present invention as the sole sensitizer is equivalent to that obtained with prior art combinations of two or more sensitizers required to cover the same spectral region.

The dyes of the present invention are also suitable for use in combination with other dyes to panchromatically sensitize silver halide emulsions. Dyes employed with the dyes of the present invention should absorb in the red region of the spectrum; i.e., in wavelength regions longer than 600 nm.

The sensitizer is incorporated into the emulsion by well-known techniques, such as by being uniformly distributed throughout a washed emulsion in a concentration dependent on the sensitometric characteristics of the particular emulsion, grain size, and the effect desired. Generally, between 0.5 to 5 mgs and, preferably 1-3 mgs of dye per gram of silver are employed. As will be apparent to those of ordinary skill in the art, the optimum ratio for any particular emulsion or photographic system may be readily determined by routine experimentation.

The photoresponsive material of the photographic emulsion will preferably comprise one or more of the silver halides such as silver chloride, silver iodide, silver bromide, or mixed silver halides such as silver chlorobromide, silver iodobromide, silver chlorobromoiodide, or mixtures thereof, of varying halide ratios and varying silver concentrations.

The silver halide crystals may be prepared by reacting a water-soluble silver salt, such as silver nitrate, with at least one water-soluble halide, such as ammonium, potassium or sodium bromide, preferably together with a corresponding iodide, in an aqueous solution of a peptizing agent such as a colloidal gelatin solution; digesting the dispersion at an elevated temperature to provide increased crystal growth; washing the resultant dispersion to remove undesirable reaction products and residual water-soluble salts by chilling the dispersion, noodling the set dispersion, and washing the noodles with cold water, or alternatively, employing any of the various flocculation systems or procedures, adapted to effect removal of undesired components; afterripening the dispersion at an elevated temperature in combination with the addition of gelatin and various adjuncts, for example, chemical sensitizing agents; all according to the traditional procedures of the art as described, for example in Neblette, C. B., *Photography Its Materials and Processes,* 6th Ed., 1962.

As the binder for the emulsion, the aforementioned gelatin may be, in whole or in part, replaced with some other natural colloidal material such as albumin, casein, or zein, or synthetic resins such as cellulose derivatives, polyacrylamides, and vinyl polymers.

Additional optional additives, such as coating aids, hardeners, viscosity-increasing agents, stabilizers, preservatives, and the like, also may be incorporated in the emulsion formulation, according to the conventional procedures known in the photographic emulsion manufacturing art and described in a multiplicity of U.S. and foreign patents. Examples of such optional additives include chemical sensitizers (e.g. reducing agents, sulfur, selenium or tellurium compounds; gold, platinum or palladium compounds, or combinations of these), stabilizers and antifoggants (e.g., noble metal salts such as rhodium, palladium, iridium and platinum; mercury compounds; triazoles; azaindenes; disulfides; benzothiazolium compounds; zinc and cadmium salts; mercapto compounds, etc.), speed-increasing compounds (e.g., quaternary ammonium compounds, polyalkylene glycols, thiopolymers and thioethers, cationic surface active agents, or combinations of these), hardening agents (e.g., inorganic agents providing polyvalent metallic atoms such as potash alum and chrome alum) aldehydes (e.g., formaldehyde, glyoxal, mucochloric acid) blocked aldehydes, ketones, quinones, carboxylic acid derivatives, sulfonate esters, sulfonyl halides, vinyl sulfones, active halogen compounds, epoxy compounds, aziridines, active olefins, isocyanates, carbodiimides, mixed function hardeners and polymeric hardeners (e.g., oxidized polysaccharides, etc.), coating aids (e.g., saponin, a polyethylene glycol, a polyethylene glycol ether, a taurine, a maleopimarate, an amino acid, a sulfosuccinate, a polyether, a gelatin plasticizer such as glycerin, a dihydroxyalkane, a bisglycolic acid ester, a succinate, a polymeric hydrosol, silicone resins, alkyl aryl sulfonates, etc.), auxiliary developing agents (e.g., hydroquinones such as 4'-methylphenylhydroquinone, catechols, aminophenols, 1,-phenyl-3-pyrazolidone, ascorbic acid and its derivatives, reductones and phenylenediamines, or combinations of developing agents), and the like.

The emulsion may be coated onto various types of rigid or flexible supports, for example, glass, paper, metal, polymeric films of both the synthetic types and those derived from naturally occuring products, etc. Especially suitable materials include paper, aluminum, polymethacrylic acid, methyl and ethyl esters, vinyl chloride polymers, polyvinyl acetals, polyamides such as nylon, polyesters such as the polymeric films derived from ethylene glycol terephthalic acid, polymeric cellulose derivatives such as cellulose acetate, triacetate, nitrate, propionate, butyrate, acetatebutyrate, or acetate-propionate, polycarbonates, polystyrenes, etc.

The emulsions of this invention can be coated by the various coating procedures in the art such as dip coating, air knife coating, curtain coating, extrusion coating, etc.

Emulsions spectrally sensitized as described herein are useful in a variety of photographic processes, for example, in colloid transfer processes such as described in Yackel et al U.S. Pat. No. 2,716,059; silver salt diffusion transfer process such as described in Rott U.S. Pat. No. 2,352,014, Land U.S. Pat. No. 2,543,181, Yackel U.S. Pat. No. 3,020,155 and Land U.S. Pat. No. 2,861,885; color image transfer processes such as described in Rogers U.S. Pat. Nos. 3,087,817; 3,185,567; and 2,983,606; Weyerts U.S. Pat. No. 3,253,915; Whitmore et al U.S. Pat. Nos. 3,227,550; 3,227,551 and 3,227,552 and Land U.S. Pat. Nos. 3,415,644; 3,415,645; 3,415,646; and imbitition transfer processes as described in Minsk U.S. Pat. No. 2,882,156.

As previously mentioned, the present invention has especially useful employment in subtractive color photographic diffusion transfer processes and products, particularly those color processes which employ dye developers, i.e., compounds possessing the properties of both a dye and a photographic silver halide developing agent. Such processes and products are well known to the photographic art and are disclosed in a multiplicity of U.S. and foreign patents.

Generally speaking, diffusion transfer systems rely for color image formation upon a differential in mobility or solubility of a dye image-providing material obtained as a function of development of exposed silver halide so as to provide an imagewise distribution of such material which is more diffusible and which is therefore selectively transferred, at least in part, by diffusion, to a superposed dyeable stratum to impart thereto the desired color transfer image. The differential in mobility or solubility may, for example, be obtained by a chemical action such as a redox reaction or a coupling reaction.

In any of these systems, multicolor images are obtained by employing a film unit containing at least two selectively sensitized silver halide emulsions each having associated therewith a dye image-providing material exhibiting desired spectral absorption characteristics. The most commonly employed elements of this type are the so-called tripack structures employing a blue-, a green- and a red-sensitive silver halide layer having associated therewith, respectively, a yellow, a magenta and a cyan dye image-providing material. The dye combination of the present invention, as previously indicated, is useful in providing the green-sensitive emulsion of these photographic elements.

Multicolor images may be obtained using the previously mentioned dye developers by several techniques. One such technique contemplates obtaining multicolor transfer images utilizing dye developers by employment of an integral multilayer photosensitive element, such as is disclosed in the aforementioned U.S. Pat. No. 2,983,606, and particularly with reference to FIG. 9 of the patent's drawing, wherein at least two selectively sensitized photosensitive strata, superposed on a single support, are processed, simultaneously and without separation, with a single, common image-receiving layer. Other techniques require the separation of the image-receiving layer from the remainder of the film unit in order to view the image.

A suitable arrangement for the photosensitive element comprises a support carrying a red-sensitive silver halide emulsion stratum, a green-sensitive silver halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion layer, for example, in the form of particles, or it may be employed as a layer behind the appropriate silver halide emulsion strata. Each set of silver halide emulsion and associated dye developer strata are disclosed to be optionally separated from other sets by suitable interlayers, for example, by a layer of gelatin or polyvinyl alcohol.

The dye developers associated with the green-sensitive emulsion in the film unit of the present invention are dye image-forming materials which are preferably selected for their ability to provide a color that is useful in carrying out subtractive color photography, that is, the previously mentioned magenta color. The magenta dye developer employed may be incorporated in the silver halide emulsion or, in the preferred embodiment, in a separate layer behind the silver halide emulsion. Such a layer of dye developer may be applied by use of a coating solution about 0.5 to 8% by weight of the dye developer dispersed in a film-forming natural, or synthetic, polymer, for example, gelatin, polyvinyl alcohol, and the like, adapted to be permeated by the chosen diffusion transfer fluid processing composition.

Image-receiving elements, particularly adapted for employment in the preceding diffusion transfer processes, comprise a support layer possessing on one surface thereof, in sequence, a polymeric acid layer, preferably an inert timing or spacer layer, and an image-receiving layer adapted to provide a visible image upon transfer to said layer of diffusible dye image-forming substance such as disclosed in, for example, U.S. Pat. No. 3,362,819.

It will be apparent that, by appropriate selection of the image-receiving element materials from among suitable known opaque and transparent materials, it is possible to obtain either a colored positive reflection print or a colored positive transparency.

As disclosed in the previously cited patents, the liquid processing composition referred to for effecting multicolor diffusion transfer processes comprises at least an aqueous solution of an alkaline material, for example, diethylamine, sodium hydroxide or sodium carbonate and the like, and preferably possessing a pH in excess of 10, and most preferably, viscosity-increasing compound constituting a film-forming material of the type which, when the composition is spread and dried, forms a relatively firm and relatively stable film. It will be noted that the liquid processing composition employed may also contain one or more auxiliary or accelerating developing agents, such as p-methylaminophenol, 2,4-diaminophenol, p-benzylaminophenol, hydroquinone, toluhydroquinone, phenylhydroquinone, 4'-methylphenylhydroquinone, etc. Such auxiliary developing agents may be employed in the liquid processing composition or they may be initially incorporated, at least in part, in any one or more of the silver halide emulsion strata, the strata containing the dye developers, the interlayers, the overcoat layer, the image-receiving layer, or in any other auxiliary layer, or layers, of the film unit. It will also be apparent that the relative proportions of the agents of the diffusion transfer processing composition may be altered to suit the requirements of the operator. Thus, it is within the scope of this invention to modify the herein described developing compositions by the substitution of preservatives, alkalies, silver halide solvents, etc., other than those specifically mentioned, and include in the developing composition components such as restrainers, accelerators, etc.

The following examples illustrate the preparation of the novel dyes of the present invention.

EXAMPLE 1

10.0 g (0.041 moles) of 2-methyl-3-sulfopropyl benzoxazolium betaine, 12.4 g (0.076 moles) of triethylorthoacetate, and 5 g of phenol were combined and heated at 110° C. for 3 minutes. The reaction was then cooled, diluted with 100 ml acetone and poured into 1 liter of hexane. The hexane was decanted and the residue redissolved in a minimum of methylene chloride. The solution was then poured slowly into ether. A pale yellow solid formed and was collected, washed with ether and dried in a heated vacuum desiccator. The yield was 6.5 g (49%) of 2-(2-ethoxypropenyl)-3-sulfopropyl-benzoxazolium betaine.

0.93 g (0.003 moles) of the thus-formed intermediate, 1.10 g (0.003 moles) of 3-ethyl-5-fluoro-2-methylbenzothiazolium tosylate, 25 ml of 2-methoxyethanol and 0.34 ml of triethylamine were combined and stirred overnight. The crude dye was collected and recrystallized from trifluoroethanol/2-methoxyethanol (1:1). The yield was 15% of

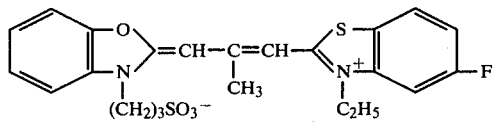

EXAMPLE 2

5-chloro-2-methyl-3-(3'-sulfopropyl) benzoxazolium betaine (2.0 g) and 5-fluoro-2-methylbenzothiazolium tosylate (2.04 g) were placed in a 50 ml round bottom flask with 20 ml of acetonitrile. About 0.775 ml of triethylamine was added and a solid began precipitating within minutes. The mixture was stirred for 2 days and nights. The solid was collected and recrystallized several times from 2-methyoxyethanol and trifluoroethanol and finally recrystallized from hot trifluoroethanol.

The yield was 23% of

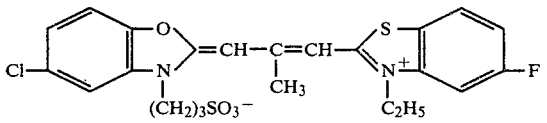

The novel sensitizing dyes of the present invention were evaluated in the following film structure:

EXAMPLE A

A polyester base was coated with 150 mg/ft$^2$ of the cyan dye developer

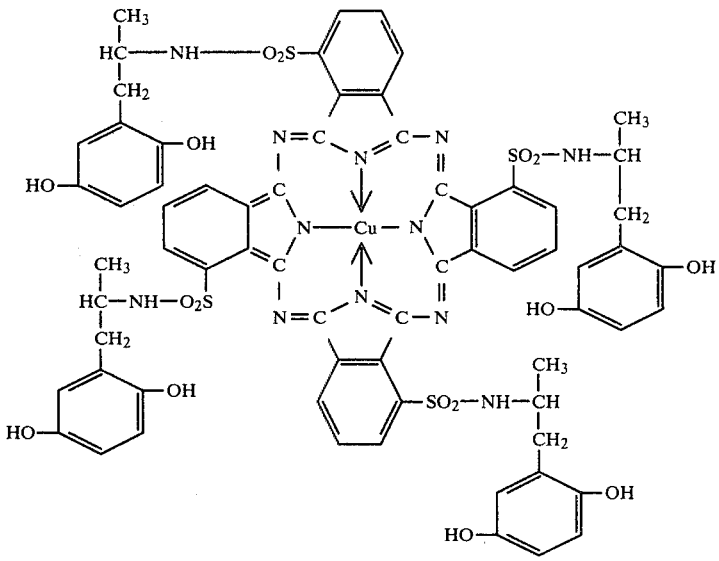

and 150 mg/ft$^2$ of a silver iodobromide emulsion (1%I) sensitized with the below-specified dyes. The coatings were exposed to a sensitometric step wedge target at 2 mcs using an Xenon flash tube with the below indicated filters. The exposed film unit was processed through laboratory rollers with a Polaroid SX-70 receiving layer and processing composition. The structure was held intact and the positive image was measured with a reflection densitometer.

In the Table 1 the spectrometric results obtained from the above described monochrome testing is set forth. The following dyes were included for comparison with the dyes of the present invention.

(A) anhydro-5,6-dichloro-1,3-diethyl-3'-(4''-sulfobutyl)-benzimidazolothiacarbocyanine hydroxide (0.87 mg/g Ag) and (B) 5,5'-diphenyl-9-ethyl-3,3'-bis-(4-sulfobutyl)-oxacarbocyanine (0.29 mg/g Ag).

TABLE 1

| Example | 1.0 Intercept Speed Minus Blue | Blue | Dmax | Dmin |
|---|---|---|---|---|
| Control A Unsensitized Emulsion | — | 2.53 | 2.38 | 0.35 |
| Control B Dye A | 2.81 | 2.35 | 2.24 | 0.36 |
| Control C Dyes A & B | 3.06 | 2.62 | 2.06 | 0.31 |
| Example 1 Dye (1.5 mg/g Ag) | 3.01 | 2.44 | 1.92 | 0.35 |
| Example 2 Dye (1.5 mg/g Ag) | 3.09 | 2.63 | 1.67 | 0.41 |

The 1.0 intercept speed labeled "Minus Blue" was obtained from a H&D curve generated on emulsions exposed through a #12 Wratten filter. The 1.0 intercept speed labeled "Blue" was obtained using a #47B Wratten filter.

From Table 1 it will be seen that the speed obtained with the single dye of the present invention is substantially the same as that obtained with the combination of dyes.

EXAMPLE B

A photosensitive element was prepared by coating, in succession, on a gelatin subbed, opaque polyethylene terephthalate film base, the following layers:

1. a layer of cyan dye developer dispersed in gelatin and coated at a coverage of about 50 mg/ft$^2$ of dye, about 100 mg/ft$^2$ of gelatin, and about 5 mg/ft$^2$ of 4'-methylphenyl-hydroquinone;
2. a red-sensitized silver iodobromide emulsion layer coated at a coverage of about 80 mg/ft$^2$ of silver and about 104 mg/ft$^2$ of gelatin;
3. an interlayer coated at a coverage of about 594 mg/ft$^2$ of a 60-30-4-6 tetrapolymer of butylacrylate, diacetone acrylamide, styrene and methacrylate acid, about 30 mg/ft$^2$ of polyacrylamide permeator, and about 4 mg/ft$^2$ of succindialdehyde as a hardener;

4. a layer of magenta dye developer dispersed in gelatin and coated at a coverage of about 60 mg/ft$^2$ of dye, about 42 mg/ft$^2$ of gelatin;
5. a silver iodobromide emulsion layer sensitized to green with the spectral sensitizing dyes set forth below at a coverage of 84 mg/ft$^2$ of silver and 40 mgs/ft$^2$ of gelatin;
6. an interlayer containing the tetrapolymer referred to above in layer 3 at a coverage of about 250 mg/ft$^2$, about 20 mg/ft$^2$ of polyacrylamide, and about 3 mg/ft$^2$ of succindialdehyde as a hardener;
7. a layer of yellow dye developer dispersed in gelatin and coated at a coverage of about 67 mg/ft$^2$ of dye and about 32 mg/ft$^2$ of gelatin;
8. a blue-sensitized silver iodobromide emulsion layer.
9. an overcoat layer coated at a coverage of about 40 mg/ft$^2$ of gelatin and 4 mg/ft$^2$ of carbon.

An image-receiving element comprising the following layers in succession on a 4 mil polyethylene terephthalate film base, said layers respectively comprising:

1. as a polymeric acid layer, the partial butyl ester of polyethylene/maleic anhydride copolymer at a coverage of about 2,500 mg/ft$^2$;
2. a timing layer containing about a 75:1 ratio of a 60-30-4-6 copolymer of butylacrylate, diacetone acrylamide, styrene and methacrylic acid and polyvinyl alcohol at a coverage of about 500 mg/ft$^2$; and
3. a polymeric image-receiving layer containing a 2:1 mixture, by weight, of polyvinyl alcohol and poly-4-vinylpyridine, at a coverage of about 300 mg/ft$^2$.

The following processing composition was employed:

| | Weight % |
|---|---|
| Potassium hydroxide | 5.25 |
| N—phenethyl-α-picolinium bromide (50% solution in water) | 1.27 |
| Sodium carboxymethyl hydroxyethyl cellulose (Hercules Type 420H0) | 2.0 |
| Titanium dioxide | 37.4 |
| 6-methyl uracil | 0.7 |
| bis-(β-aminoethyl)-sulfide | 0.02 |
| Benzotriazole | 5.48 |
| Colloidal silica aqueous dispersion (30% $SiO_2$) | 0.55 |
| N—2-hydroxyethyl-N', N'—tris-carboxymethylethylene diamine | 0.75 |
| 4-amino pyrazolo[3,4d]pyrimidine | 0.25 |
| 6-benzylaminopurine | 0.41 |
| Polyethylene glycol (molecular weight 4,000) | 0.45 |
| Water | 44.16 |

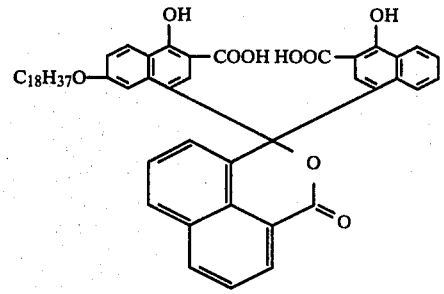

1.35

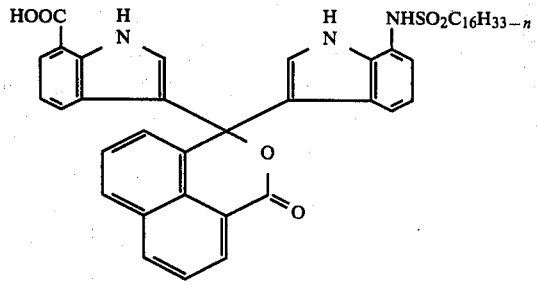

0.3

The green-sensitive emulsion in the above identified film unit was sensitized in one case with the dye of Example 1 at a dye load of 1.5 mg/g Ag and in another case with the combination of two dyes:

(A) anhydro-5,6-dichloro-1,3-diethyl-3'-(4''-sulfobutyl)-benzimidazolothiacarbocyanine hydroxide (0.87 mg/g Ag) and (B) 5,5'-diphenyl-9-ethyl-3,3'-bis-(4-sulfobutyl)-oxacarbocyanine (0.29 mg/g Ag).

The photosensitive elements were exposed to a multicolor target and the processing composition was spread in the dark between the photosensitive element and the image-receiving element in a layer approximately 0.0028" thick. After the image cleared, about 5 min., the resulting positive images were then read to red, green and blue light in a recording densitometer without separation from the negative.

TABLE 2

| | Dmax | | | 0.75 Intercept Speed | | |
|---|---|---|---|---|---|---|
| | R | G | B | R | G | B |
| Example 1 Dye | 1.73 | 2.19 | 1.98 | 2.11 | 2.06 | 2.04 |
| Control (A & B) | 1.79 | 2.17 | 1.93 | 2.08 | 2.05 | 2.22 |

From the above, it will be seen that the sensitivity of the prior art combination of dyes is substantially matched employing the single dye of the present invention.

The long term shelf stability of the film units of Example B containing the Example 1 Dye compared to a film unit containing Dyes A and B is illustrated in Table 3. The film units were exposed and processed as described above. Table 3 shows the initial $D_{max}$, $D_{min}$ and speed and the change in $D_{max}$, $D_{min}$ and speed after 1 year room temperature, 45° relative humidity storage. It will be seen that there is reduced loss in green and blue $D_{max}$ and speed in the dye of the present invention compared to the prior art combination of dyes.

TABLE 3

| | Initial | | | | | | | | |
|---|---|---|---|---|---|---|---|---|---|
| | Dmax | | | Dmin | | | 0.75 Intercept Speed | | |
| Control | R | G | B | R | G | B | R | G | B |
| Dyes A & B | 2.05 | 2.37 | 1.74 | 0.21 | 0.21 | 0.17 | 2.08 | 2.16 | 2.40 |
| Example 1 Dye | 2.03 | 2.26 | 1.69 | 0.21 | 0.21 | 0.18 | 2.10 | 2.18 | 2.36 |
| | 1 Year | | | | | | | | |
| | Δ Dmax | | | Δ Dmin | | | 0.75 Intercept Speed | | |
| Control | R | G | B | R | G | B | R | G | B |
| Dyes A & B | −0.31 | −0.37 | −0.20 | −0.03 | −0.03 | +0.03 | −0.18 | −0.17 | −0.20 |
| Example 1 Dye | −0.34 | −0.30 | −0.08 | −0.02 | −0.01 | +0.03 | −0.05 | +0.02 | −0.09 |

Figure 2:
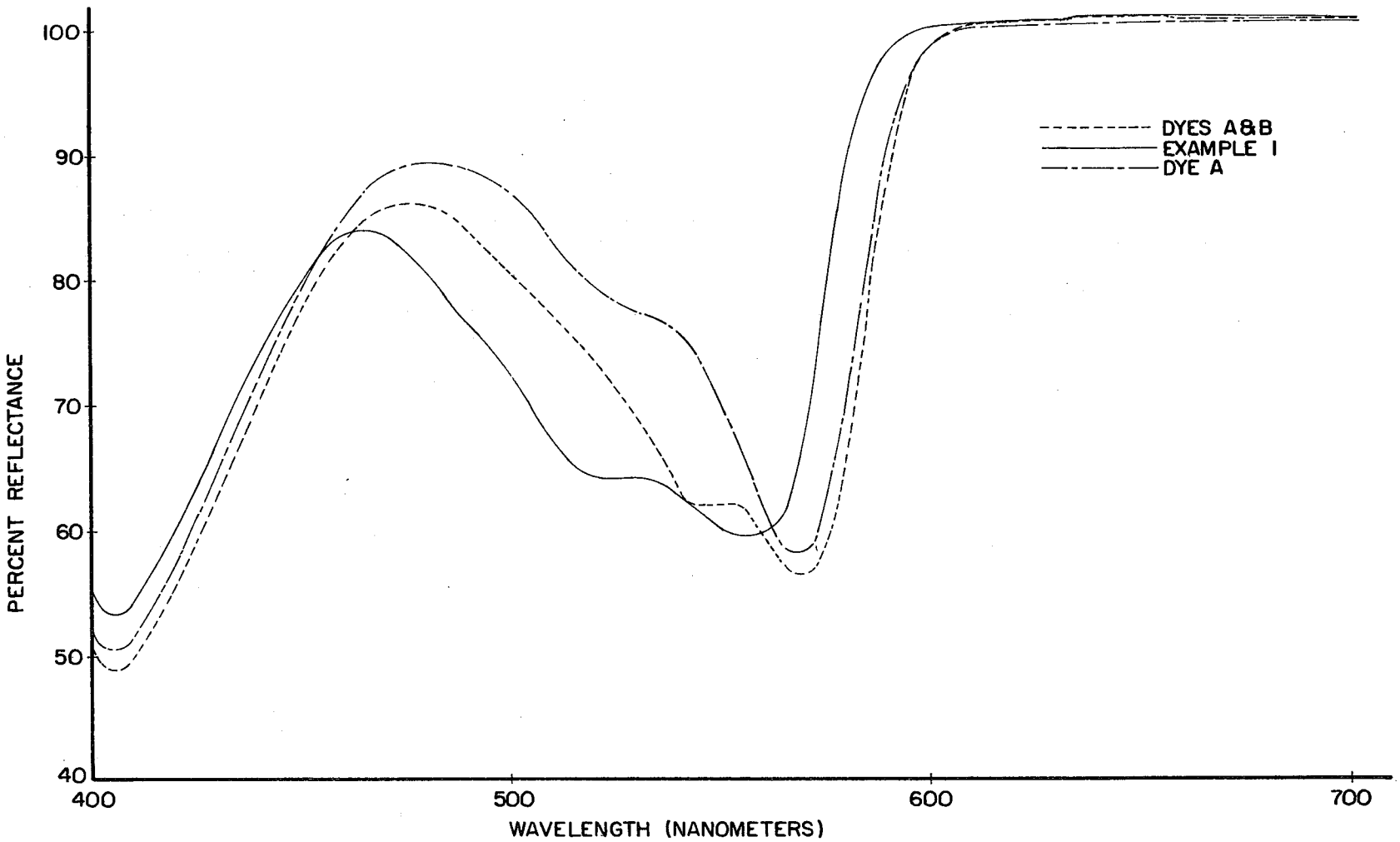
FIG. 2 shows a comparison of reflection spectra of the emulsion shown in FIG. 1 which has been sensitized with a single prior art green dye, a combination of two prior art green dyes and a dye of the present invention.

The above-mentioned broad spectral response of the dyes of the present invention will be seen by the reference to FIGS. 1 and 2. FIGS. 1 and 2 show percent reflectance values measured by a Cary spectrophotometer on the above-described silver iodobromide emulsion at a coverage of 150 mg/ft$^2$ of silver coated on a reflective paper. For reference, FIG. 1 shows the percent reflectance values between 400 and 700 nanometers on the unsensitized silver iodobromide emulsion. FIG. 2 compares the percent reflectance values of the Example 1 dye of the present invention, prior art Dye A and the prior art combination of Dyes A&B. It will be seen that Dye A, as a single dye has a very narrow spectral response band and requires the addition of Dye B to provide the necessary spectral band width. The Dye of the present invention provides an even wider spectral response than the combination of dyes.

In order to evaluate the effectiveness of the dyes of the present invention and prior art dyes to remain absorbed to the silver halide grain in the presence of stabilizer the following test was carried out.

Silver iodobromide emulsion was melted at 42° C. and the dyes to be tested were added with agitation. Thirty minutes after dye addition a solution of stabilizer, 4-hydroxy-6-methyl-1,3,3a, 7-tetrazaindene, was added at a level of 4 mg/g Ag. Thirty minutes after the stabilizer addition, and at twenty-four hours after the stabilizer addition, the emulsion was sampled and coated on reflective paper at a coverage of 150 mg/ft$^2$, and reflection spectra were obtained.

Figure 3:
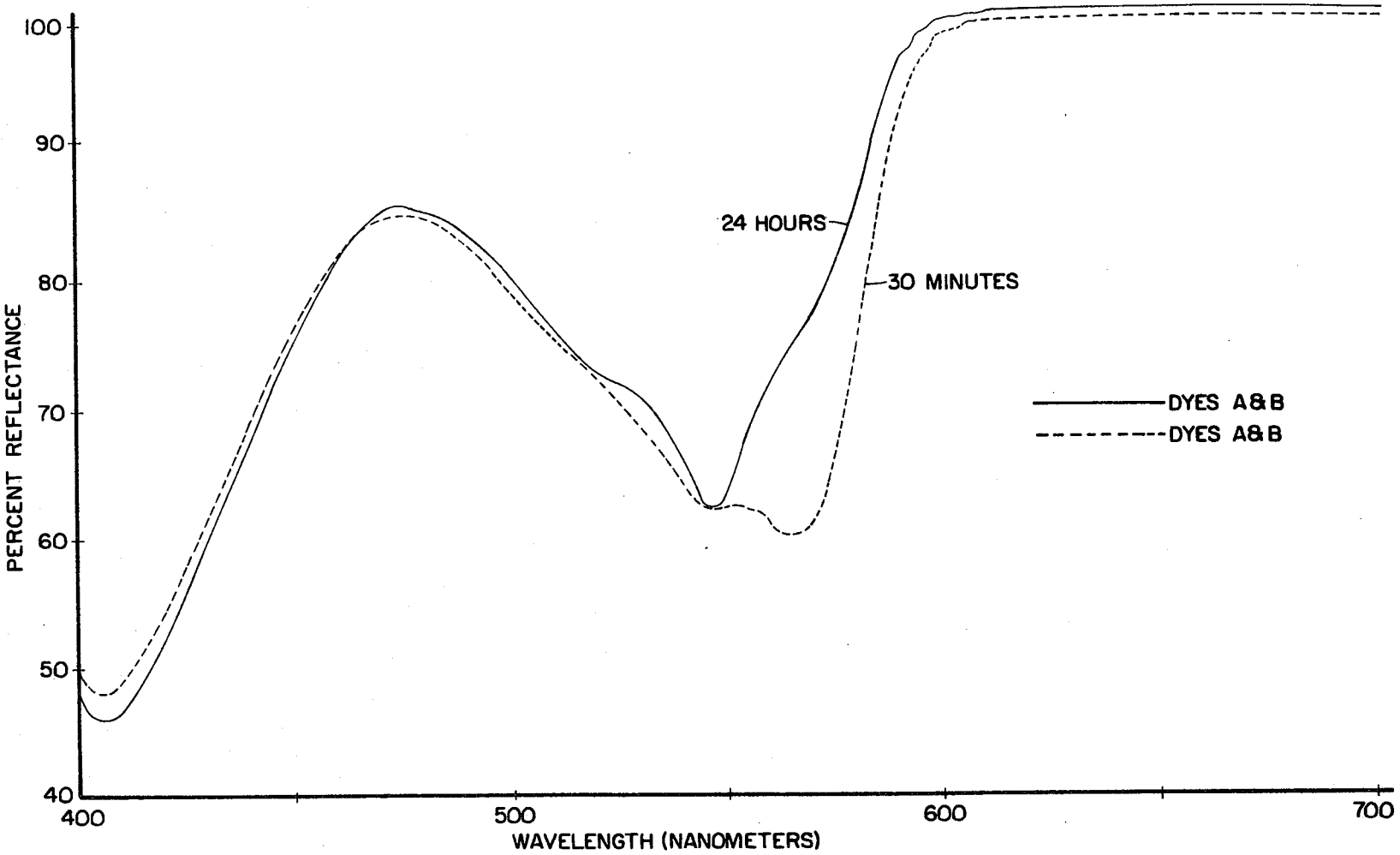
FIG. 3 shows the reflection spectra of an emulsion containing prior art dyes and a stabilizer 30 minutes and 24 hours after preparation.

FIG. 3 is the reflection spectrum for the emulsion containing Dyes A and B and the dye displacement from the grains by the stabilizer is readily apparent in comparing the width of the 30 minute curve to the 24 hour curve.

Figure 4:
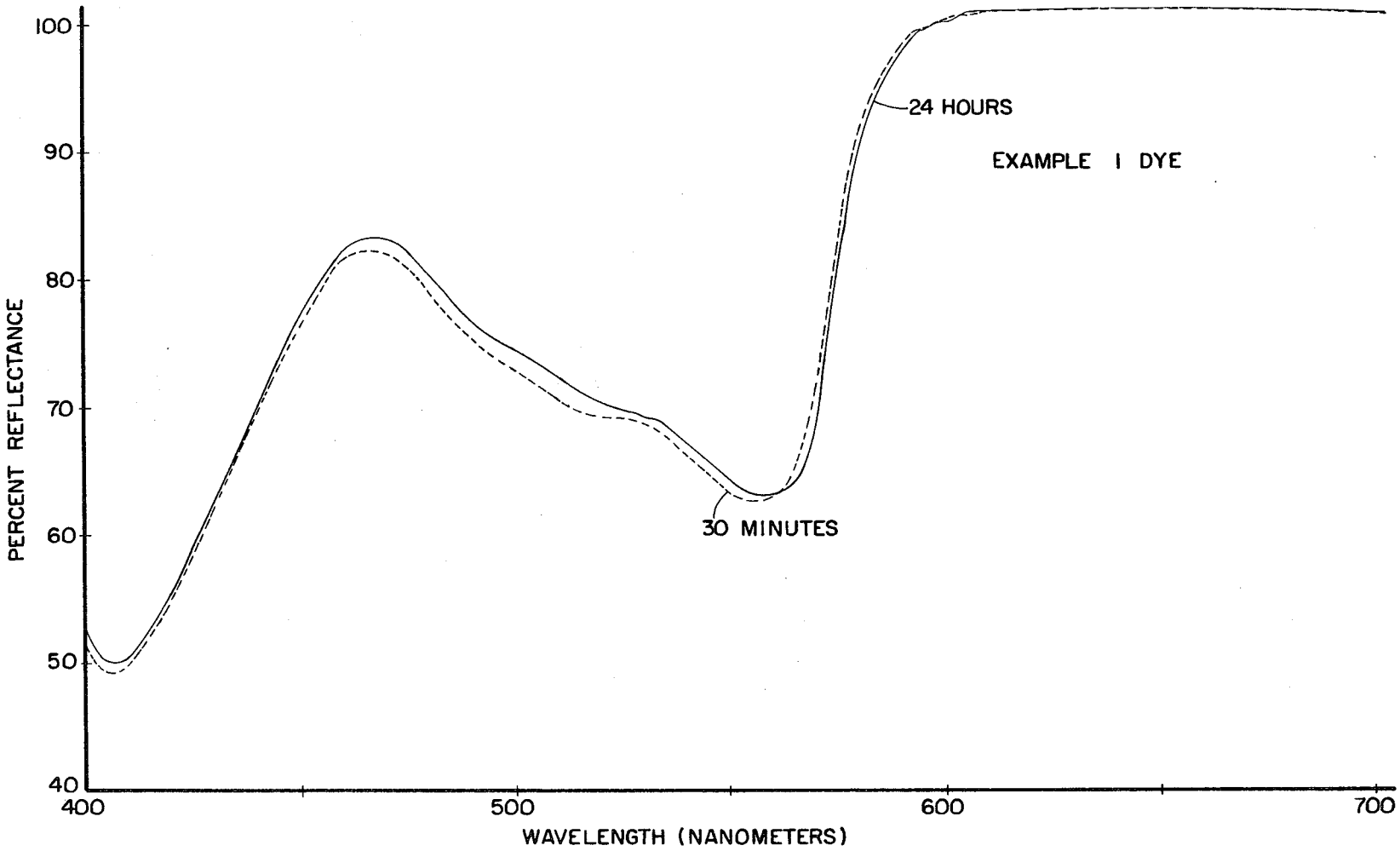
FIG. 4 shows the reflection spectra of an emulsion containing a dye of the present invention and a stabilizer 30 minutes and 24 hours after preparation.
Figure 5:
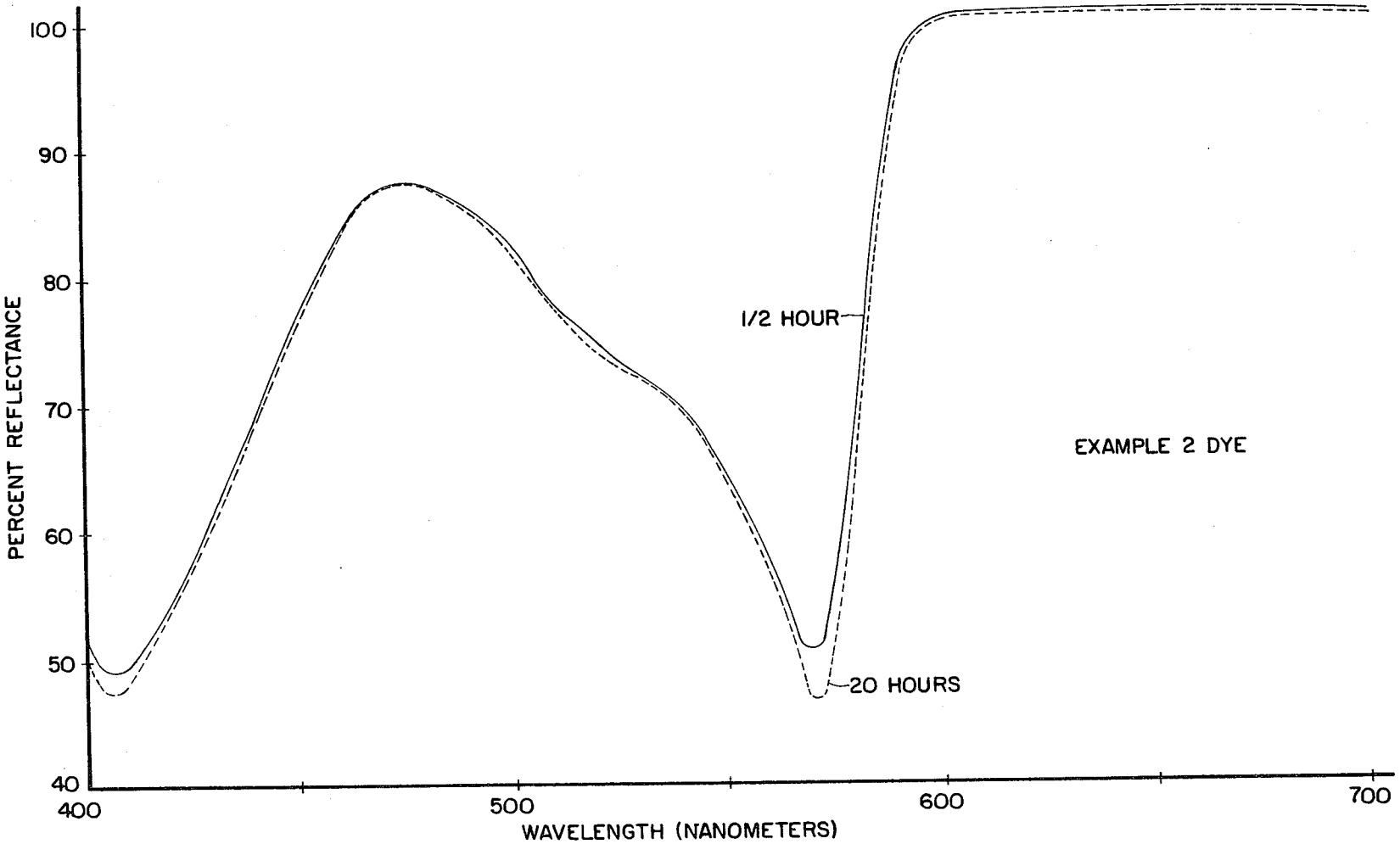
FIG. 5 shows the reflection spectra of an emulsion containing another dye of the present invention and a stabilizer 30 minutes and 20 hours after preparation.

FIG. 4 is the reflection spectrum for the emulsion containing the dye of Example 1. Very little change in the spectrum has occured between the 30 minute and 24 hour sample indicating substantially no dye displacement by the stabilizer. Similar results are seen in FIG. 5 which show the spectra for the dye of Example 2.

Although the invention has been discussed in detail throughout employing dye developers, the preferred dye image-forming materials, it will be readily recognized that other, less preferred, dye image-providing materials may be substituted in replacement of the preferred dye developers in the practice of the invention. For example, there may be employed dye image-forming materials such as those disclosed in U.S. Pat. Nos. 2,647,049; 2,661,293; 2,698,244; 2,698,798; and 2,802,735, wherein color diffusion transfer processes are described which employ color coupling techniques comprising, at least in part, reacting one or more color developing agents and one or more color formers or couplers to provide a dye transfer image to a superposed image-receiving layer and those disclosed in U.S. Pat. No. 2,774,668 wherein color diffusion transfer processes are described which employ the imagewise differential transfer of complete dyes by the mechanisms therein described to provide a transfer dye image to a contiguous image-receiving layer.

What is claimed is:

1. A photosensitive silver halide emulsion containing as a green sensitiver a dye of the formula

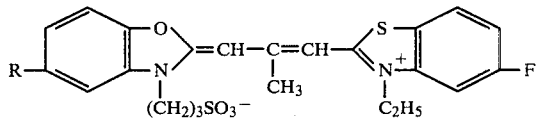

wherein R is hydrogen or chlorine.

2. The emulsion of claim 1 wherein R is hydrogen.

3. The emulsion of claim 1 wherein R is chlorine.

4. The emulsion of claim 2 wherein said dye is the sole sensitizing dye.

5. The emulsion of claim 1 which includes at least a second sensitizing dye to provide panchromatically sensitized emulsions.

6. A photosensitive element comprising a support carrying a red-sensitive silver halide emulsion; a green-sensitive silver halide emulsion and a blue-sensitive silver halide emulsion; wherein said green-sensitive silver halide emulsion containing as a spectral sensitizer is a dye of the formula:

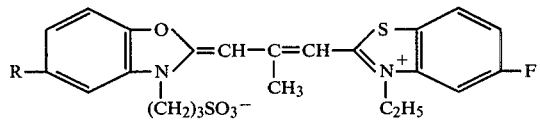

wherein R is hydrogen or chlorine.

7. The element of claim 6 wherein R is hydrogen.

8. The element of claim 6 wherein R is chlorine.

9. The element of claim 7 wherein said dye is the sole spectral sensitizer in said green emulsion.

10. The element of claim 6 wherein each of said emulsions has associated therewith a dye image color providing material.

11. The element of claim 10 wherein said red-sensitive silver halide emulsion has associated therewith a cyan dye developer; said green-sensitive silver halide emulsion has associated therewith a magenta dye developer and said blue-sensitive silver halide emulsion has associated therewith a yellow dye developer.

12. The element of claim 6 wherein said dye is present at a level of about 0.5 to 5 mg/g of silver.

13. A photographic film unit which comprises, in combination:

a photosensitive element having a diffusion transfer image-receiving element affixed at least one edge thereof, said photosensitive element affixed at least one edge thereof, said photosensitive element comprising a support carrying:

(a) a red-sensitive silver halide emulsion having associated therewith a cyan dye developer;

(b) a green-sensitive silver halide emulsion having associated therewith a magenta dye developer;

(c) a blue-sensitive silver halide emulsion having associated therewith a yellow dye developer;

said green-sensitive emulsion including as the sole spectral sensitizer a dye of the formula

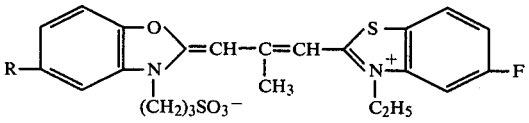

wherein R is hydrogen or chlorine;

an alkaline processing composition permeable and dyeable layer wherein said photosensitive and said image-receiving elements are adapted to be superposed, the support layers of each comprising the extremities of the superposed structure.

14. The film unit of claim 13 including a rupturable container retaining an aqueous alkaline processing composition affixed to one edge of said photosensitive element and said image-receiving element and adapted to rupture its contents intermediate said superposed photosensitive and image-receiving elements.

15. The film unit of claim 14 wherein the support layer of said image-receiving element is transparent.

16. The film unit of claim 15 in which said unit is a composite structure comprising said photosensitive element and said image-receiving element permanently affixed to the other in superposed relationship, the support layers of each of said elements being outermost.

17. The film unit of claim 13 wherein R is hydrogen.

18. The film unit of claim 13 wherein R is chlorine.

19. As a novel composition of matter

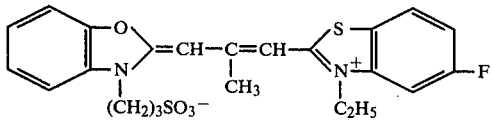

20. As a novel composition of matter

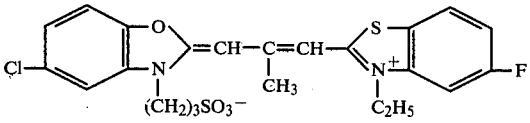

* * * * *